US009381660B2

(12) United States Patent
Schaub

(10) Patent No.: US 9,381,660 B2
(45) Date of Patent: Jul. 5, 2016

(54) METHOD AND APPARATUS FOR SLICING PRODUCTS

(71) Applicant: Weber Maschinenbau GmbH Breidenbach, Breidenbach (DE)

(72) Inventor: Joachim Schaub, Hatzfeld-Reddighausen (DE)

(73) Assignee: WEBER MASCHINENBAU GMBH BREIDENBACH, Breidenbach (DE)

( * ) Notice: Subject to any disclaimer, the term of this patent is extended or adjusted under 35 U.S.C. 154(b) by 0 days.

(21) Appl. No.: 14/264,287

(22) Filed: Apr. 29, 2014

(65) Prior Publication Data

US 2014/0318333 A1 Oct. 30, 2014

(30) Foreign Application Priority Data

Apr. 29, 2013 (DE) ..... 10 2013 207 788

(51) Int. Cl.

*B26D 1/00* (2006.01)
*B26D 7/06* (2006.01)
*B26D 7/01* (2006.01)
(Continued)

(52) U.S. Cl.

CPC ..... *B26D 7/0625* (2013.01); *B26D 5/32* (2013.01); *B26D 5/34* (2013.01); *B26D 7/01* (2013.01); *B26D 2007/011* (2013.01); *B26D 2210/02* (2013.01); *Y10T 83/04* (2015.04); *Y10T 83/6539* (2015.04)

(58) Field of Classification Search

CPC ..... B26D 5/32; B26D 5/34; B26D 2007/11; B26D 2210/02; Y10T 83/6539
USPC ..... 83/732, 35, 36, 39, 206, 76.7, 76.6
See application file for complete search history.

(56) References Cited

U.S. PATENT DOCUMENTS 3,761,675 A * 9/1973 Mason et al. ..... 219/121.67
4,694,871 A * 9/1987 Jenkner ..... 144/35.1
5,400,652 A * 3/1995 Haar ..... 83/206
(Continued)

FOREIGN PATENT DOCUMENTS

DE 4410596 A1 10/1995
DE 102010019248 A1 11/2011
(Continued)

OTHER PUBLICATIONS

Search Report mailed Jul. 9, 2014, from German Application No. 102013207788.2 (9 pages).

*Primary Examiner* — Omar Flores Sanchez
(74) *Attorney, Agent, or Firm* — Kilpatrick Townsend & Stockton LLP

(57) ABSTRACT

In a method of slicing products, in particular food products, a plurality of products are supplied next to one another along a product support to a cutting plane in which a cutting blade moves, in particular in a rotating and/or revolving manner. The products are initially offset relative to one another in a stepped manner in the product supply direction via the product conveyors in that, starting from a first product, the further products up to the respective outermost product, which are arranged next to one another at at least one side, are set back by a respective amount against the product supply direction, and indeed further than the respective preceding product. The products offset in a stepped manner with respect to one another are traveled to light barriers at a defined speed. The positions of the product starts are detected with respect to the cutting plane via the light barriers.

20 Claims, 2 Drawing Sheets

Figure 1:
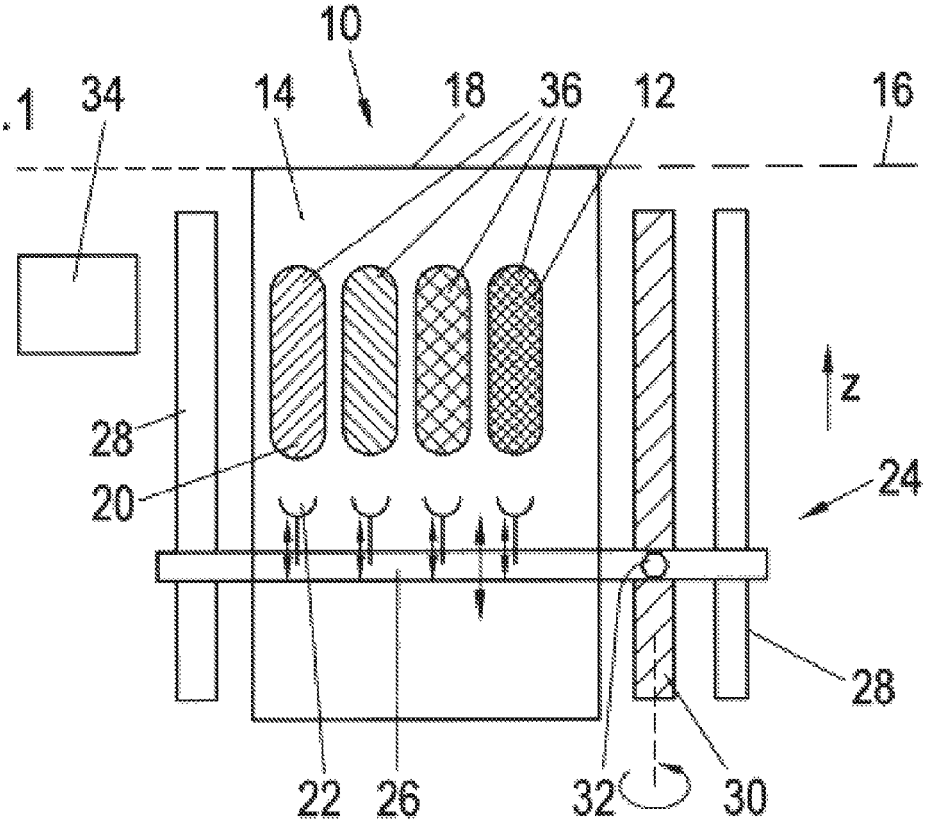

(51) Int. Cl.
*B26D 5/32* (2006.01)
*B26D 5/34* (2006.01)

(56) References Cited

U.S. PATENT DOCUMENTS 6,546,834 B1 * 4/2003 Benuzzi ..... 83/36
8,020,476 B2 * 9/2011 Hartmann et al. ..... 83/272
2012/0042757 A1 * 2/2012 Weber ..... B26D 5/20 83/23

FOREIGN PATENT DOCUMENTS

DE 102010034674 A1 2/2012
DE 102010055394 A1 6/2012
DE 102011113793 A1 3/2013
EP 2407285 A2 1/2012
EP 2420362 A1 2/2012
EP 2711147 A1 3/2014

* cited by examiner

METHOD AND APPARATUS FOR SLICING PRODUCTS

The present invention relates to a method and to an apparatus for slicing products, in particular food products.

Different types of food cutting apparatus are known. So-called high-performance slicers are, for example, used to slice food products such as meat, sausage or cheese at a high cutting speed. To increase the cutting performance, such apparatus can have a product support which is configured to supply a plurality of product loaves or product bars, called products in the following, next to one another along a product support to a cutting plane in which at least one cutting blade moves. The cutting blade can, for example, be a circular knife orbiting in planetary motion or a rotating scythe-like blade. It is possible in this manner to utilize a single cutting apparatus with a correspondingly large blade for the simultaneous cutting of a plurality of products.

The common supply of the products can also take place in the invention in that each product has its own product conveyor associated with it which is, for example, configured as a product gripper and engages at the rear end of the product to push the product forward. Alternatively or additionally, the product conveyor can also comprise one or more so-called traction belts such as, for example, a continuous conveyor belt on which the product lies. In order to compensate differences in the weight development or cross-section development of the products in this respect and to be able to vary the thickness of the cut-off product slices for the supplied products independently of one another during the slicing in order thus to be able individually to achieve a predefined weight of individual product slices or the weight of portions of a plurality of slices, the product conveyors can be fastened to a common supply unit and can be moved in and out independently of one another relative to the supply unit in and against the product supply direction. A common supply unit is, however, also not compulsory in the invention. The product conveyors can also be movable and controllable completely independently of one another.

In general, it cannot be assumed that the products disposed next to one another which were loaded by the product support have exactly the same length. Since the product conveyors are movable independently of one another, a length difference of the products can be compensated by a suitable adjustment of the product conveyors relative to one another. Since the length difference is not normally known in advance, a product search travel can be carried out to determine the positions of the products, e.g. the rear ends of the products, and to bring the product conveyors into engagement with the products or the product ends. For example, the product starts can also be aligned relative to the cutting plane during such a search and engagement process. In this respect, a compression can, however, now occur, in particular with fresh products such as fresh meat. If the product conveyors are now moved back again before the first cut, a respective compressed product can expand again, which can again result in a specific misalignment of the product starts relative to one another.

It is therefore the object of the invention to provide a method and an apparatus of the initially named kind with which, with a multi-track operation in which a plurality of products are supplied to the cutting plane simultaneously next to one another, an exact alignment of the product starts relative to the cutting plane is ensured in a manner which is as simple and as reliable as possible.

In accordance with the invention, this object is satisfied by a method having the features of claim 1 as well as by an apparatus having the features of claim 9.

In the method in accordance with the invention for slicing products, in particular food products, a plurality of products are supplied next to one another along a product support to a cutting plane in which cutting blade moves, in particular in a rotating and/or revolving manner. In this respect, the products, in particular the rear ends of the products, are brought into engagement with respective product conveyors, e.g. product grippers for the rear product ends, which—in particular supported at a common supply unit—can be moved independently of one another in and against the product supply direction relative to the supply unit. The products are initially offset relative to one another in a stepped manner in the product supply direction via the product conveyors in that, starting from a first product, the further products up to the respective outermost product, which are arranged next to one another at at least one side, are set back by a respective amount against the product supply direction, and indeed further than the respective preceding product. In addition, a respective light barrier is associated with reach product track along which a respective product is conducted; the light barrier is arranged at a defined spacing from the cutting plane, comprises a side sensor ant its monitored zone extends transversely to the product supply direction. Subsequently, the products, which are offset in a stepped manner with respect to one another are traveled toward the light barriers at a defined speed, in particular simultaneously, for example, together e.g. via a common supply unit. The positions of the product starts are then detected with respect to the cutting plane via the light barriers. In addition, the deviations of the detected positions of the product starts relative to one another are determined. For the exact alignment of the product starts with the cutting plane, the product conveyors are then traveled relative to one another so that the determined relative positional deviations of the product stars are cancelled or compensated.

Preferred further developments of the method in accordance with the invention are also set forth in the dependent claims.

In a possible embodiment, the amount by which the further products are each set back corresponds to an assumed initially maximum misalignment of the product starts relative to one another.

Provision can be made in accordance with an embodiment that the monitored zones of the light barriers each extend up to the rear margin of the respective product track, starting from the side of the product support adjacent to the product set back the furthest.

The lateral arrangement of the light barriers or sensors takes account of the circumstance that there is normally no room for such sensors available above and beneath the product support. Since the products are initially offset n a stepped manner in the indicated manner and since the light barriers are associated with the different product tracks in the named manner, it is avoided that the product to be detected by a respective light barrier is covered by other products. The light beam of a lateral sensor can therefore optionally also extend beyond one or more product tracks since it is ensured by the named step-like offset of the products and the named association of the light barriers that the light path of the light barrier is first interrupted by the product associated with the associated product track on a common supply of the offset products.

The lateral sensors can be offset relative to one another in the product supply direction and/or also in the vertical direction of the products, that is above one another vertically with respect to the product support. Only the position of a respective light barrier relative to the cutting plane also has to be known on an offset of the light barriers in the product supply direction. The intervals of the light barriers in particular do not have to correspond to an initial misalignment of the product starts.

The lateral sensor of a respective light barrier preferably comprises a light transmitter and a light receiver, with the light beam generated by the light transmitter generally being directed, starting from the respective side of the product support, transversely to the product supply direction onto a reflector. The light barriers are therefore each preferably reflection light barriers. A simple metal surface, e.g. a stainless steel sheet, can serve as a reflector, for example. Generally, any device can be considered as a reflector in the sense of the invention which is able to reflect the respectively used radiation of the light barrier at least in part. The reflector can—viewed from the light transmitter—be arranged directly behind the respective product track. In principle, the reflectors can also have the same distance from their respective light transmitters so that all the light barriers extend across all product tracks. It is also possible at least in principle within the framework of the invention to utilize the side surfaces of the products as a reflector with products suitable for this purpose and with a radiation of the light barriers adapted thereto. The arrangement of the light barriers and the manner of the offset of the products matched thereto can then be selected accordingly. The above statements also apply accordingly to the apparatus in accordance with the invention.

In accordance with a first advantageous variant of the method in accordance with the invention, starting from one of the two outermost products, the further products arranged next to them up to the oppositely disposed outermost product are each set back by a misalignment, in particular by an assumed initial maximum misalignment, of the product starts relative to one another against the product supply direction, and indeed further than the respective preceding products, with the sensors of the light barriers associated with the different product tracks being arranged at the side of the product receiver adjacent to the product set back the most. Such a variant is in particular expedient with a relatively small number of products, for example up to four products, disposed next to one another. With a correspondingly limited number of products, the travel path of the product conveyors also does not have to be all that large to bring about the step-like offset of the products.

In accordance with another variant, in particular a variant suitable for a larger number of products, of the method in accordance with the invention, the products are set back, starting from a middle region of the product support viewed transversely to the product supply direction, at both sides in each case up to the oppositely disposed outermost product by an amount, in particular corresponding to an assumed initial maximum misalignment, of the product starts relative to one another, and indeed further than the respective preceding product. In this case, in accordance with an embodiment, the sensors of the light barriers which are associated with the product tracks of the products set back in a stepped manner toward the one side are arranged at this one side of the product support, whereas the sensors of the light barriers which are associated with the product tracks of the products set back in a stepped manner toward the other side can be arranged at this other side of the product support.

It is ensured with this variant that the maximum travel path of the product conveyors to effect the step-like offset of the products also does not have to be all too large with a larger number of products. For example, 2×4 products can thus be loaded next to one another onto the product support, with four products being set back toward the one side of the product support and four products toward the other side of the product support, in each case in a step-like manner against the product supply direction, before they are together supplied to these light barriers for the detection of the product starts by the light barriers.

The products offset in a stepped manner relative to one another are expediently traveled toward the light barriers via the common supply unit at a constant speed. Since this speed is kept constant, the relative deviations of the product starts detected via the light barriers can be determined more simply.

The product conveyors brought into engagement with the products are preferably traveled different distances in and/or against the product supply direction, in particular relative to a common supply unit, before the step-like offsetting of the products. In this respect, the product conveyors can therefore remain in a random, non-predictable relative position which results after an initial product search travel, that is they do not have to be specifically aligned to detect the product starts or their deviations.

The apparatus in accordance with the invention for slicing products, in particular food products, accordingly comprises a product support along which a plurality of products can be supplied next to one another to a cutting plane in which a cutting blade moves, in particular in a rotating and/or revolving manner. The products, e.g. the rear ends of the products, can be brought into engagement with respective product conveyors, e.g. product grippers for the rear product ends, which can be traveled, in particular supported at a common supply unit, independently of one another, in particular relative to a common supply unit, in and against the product supply direction. The apparatus additionally comprises a control apparatus which is configured to offset the products in a stepped manner relative to one another in the product supply direction via the product conveyors in that, starting from a first product, the further products arranged next to it at at least one side are each set back up to the respective outermost product by a respective amount, in particular corresponding to an assumed initial maximum misalignment of the product starts relative to one another, against the product supply direction, and indeed further than the respective preceding product. In this respect, a respective light barrier is associated with each product track along which a respective product is guided, said light barrier being arranged at a defined spacing from the cutting plane, comprising a lateral sensor and its monitored zone extending transversely to the product supply direction. The control device is further configured to travel the products offset in a stepped manner with respect to one another, in particular via a common supply unit, toward the light barriers at a defined speed, to detect the positions of the product starts with respect to the cutting plane via the light barriers, to determine the differences in the detected positions of the product starts relative to one another and to travel the product conveyors relative to one another for aligning the product starts with the cutting plane such that the determined relative positional differences of the product starts are cancelled.

Preferred embodiments of the apparatus in accordance with the invention are set forth in the dependent claims.

In a possible embodiment, the amount by which the further products are each set back corresponds to an assumed initially maximum misalignment of the product starts relative to one another.

Provision can be made in accordance with an embodiment that the monitored zones of the light barriers each extend up to the rear margin of the respective product track, starting from the side of the product support adjacent to the product set back the furthest.

Furthermore, the lateral sensor of a respective light barrier preferably comprises a light transmitter and a light receiver, with the light beam generated by the light transmitter generally being directed, starting from the respective side of the product support, transversely to the product supply direction onto a reflector, in particular a reflector arranged directly behind the respective product track. In this case, the light barriers are therefore each configured as reflection light barriers.

A preferred variant of the apparatus in accordance with the invention, in particular suitable for a relatively smaller number of products, is characterized in that the control device is configured, starting from one of the two outermost products, to set the further products arranged next to one another back against the product supply direction up to the oppositely disposed outermost product in each case by an amount, in particular an amount corresponding to an assumed initial maximum misalignment of the product starts relative to one another, and indeed further than the respective preceding product, with the sensors of the light barriers associated with the different product tracks being arranged at the side of the product support adjacent to the product set back the furthest.

In accordance with another variant, in particular a variant suitable for a larger number of products, of the apparatus in accordance with the invention, the control apparatus is configured to set back the products, starting from a middle region of the product support, viewed transversely to the product supply direction, at both sides in each case up to the oppositely disposed outermost product by an amount, in particular corresponding to an assumed initial maximum misalignment, of the product starts relative to one another, and indeed further than the respective preceding product, with the sensors of the light barriers which are associated with the product tracks of the products set back in a stepped manner toward the one side being arranged at this one side of the product support, whereas the sensors of the light barriers which are associated with the product tracks of the products set back in a stepped manner toward the other side are arranged at this other side of the product support.

If a common supply unit is provided, it advantageously comprises a carrier which extends transversely to the product supply direction and is movable in and against the product supply direction and at which the product conveyors are supported independently of one another in a travelable manner. This carrier is preferably guided by means of lateral guides each extending in the product supply direction. In this respect, the carrier can be travelable via a spindle drive, for example.

Figure 2:
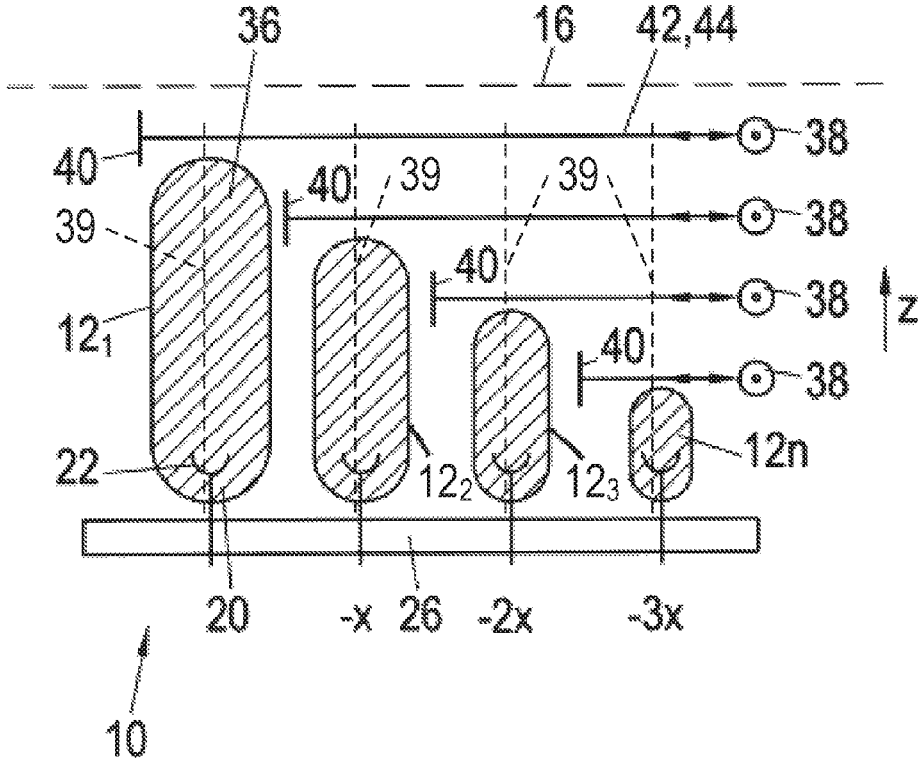
Figure 3:
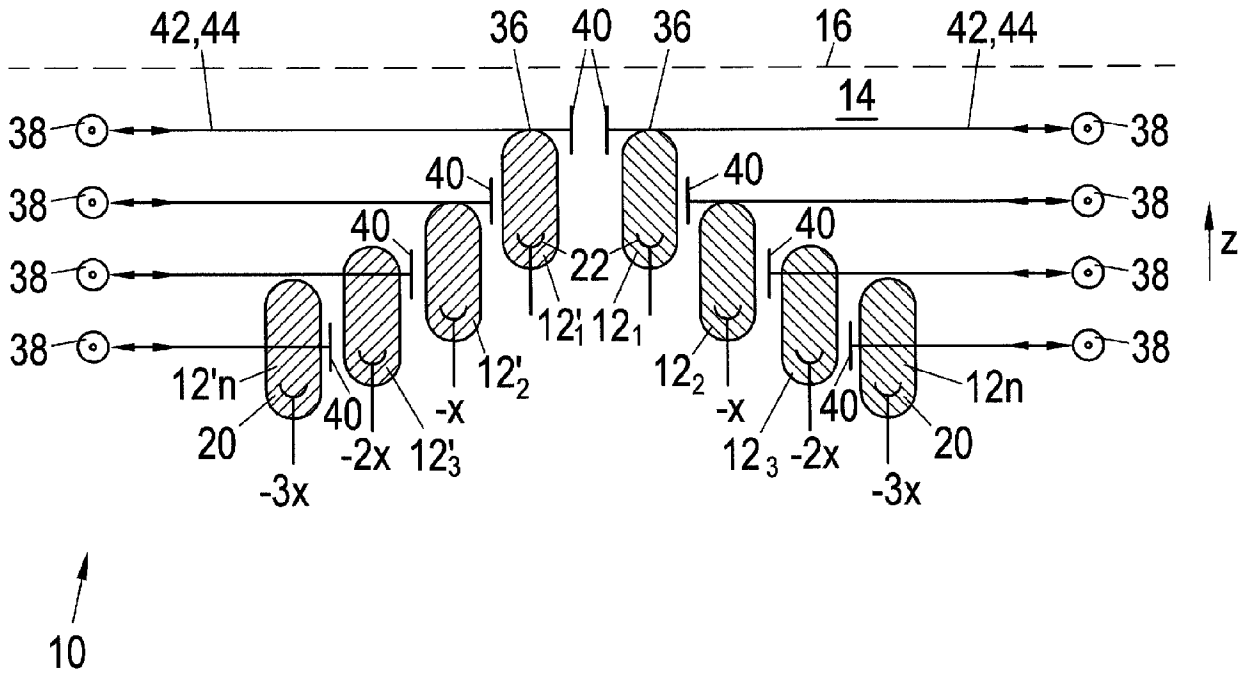

The invention will be explained in more detail in the following with reference to embodiments and to the drawing; there are shown in this:

FIG. 1 a schematic plan view of an exemplary embodiment of an apparatus for slicing products, in particular food products;

FIG. 2 an exemplary variant, in particular a variant suitable for a relatively smaller number of products, of the method in accordance with the invention or of the apparatus in accordance with the invention; and FIG. 3 an exemplary further variant, in particular a variant suitable for a relatively larger number of products, of the method in accordance with the invention or of the apparatus in accordance with the invention.

FIG. 1 shows in a schematic plan view an exemplary embodiment of an apparatus 10 for slicing products 12 which can in particular be food products.

The apparatus 10 comprises a product support 14 which can be loaded with a plurality of products 12 and along which the products 12 can be supplied next to one another to a cutting plane 16 in which a cutting blade moves, in particular in a rotating and/or revolving manner. A cutting edge 18 forms the end of the product support 14.

The rear ends 20 of the products 12 can be brought into engagement with respective product conveyors 22, which are here configured as product grippers, wherein the product conveyors 22 are supported at a common supply unit 24 and can be traveled independently of one another in and against the product supply direction Z relative to the supply unit 24. Such a common supply unit is not compulsory and the product conveyors can be moved completely independently of one another in an alternative embodiment. Instead of product grippers for the rear product ends, traction belts can be provided which engage at the lower sides and/or at the upper sides of the products.

The supply unit 24 can in particular comprise a carrier 26 extending transversely to the product supply direction Z and travelable in and against the product supply direction Z, at which carrier the product conveyors 22 are supported travelable independently of one another. As can additionally be recognized with reference to FIG. 1, the carrier 26 can be guided by means of lateral guides 28 each extending in the product supply direction Z. The carrier 26 can be travelable via a spindle drive 30 which comprises a spindle nut 32 via which the carrier 26 is taken along accordingly. The carrier 26 is moreover also guided in the direction of the product supply direction again by the spindle of the spindle drive 30.

A control apparatus 34 is moreover provided which can in particular be connected to the spindle drive 30 and to individual drives for the product conveyors 22 via which these product conveyors 22 can be traveled independently of one another in and against the product supply direction Z relative to the carrier 26.

As can in particular also be recognized with reference to FIGS. 2 and 3, the control device 34 is configured first to offset the products 12 relative to one another in a stepped manner via the product conveyors 22 in the product supply direction Z in that, starting from a first product $\mathbf{12}_1$, the further products $\mathbf{12}_2$ to $\mathbf{12}_n$ arranged next to it at at least one side are set back up to the respective outermost product $\mathbf{12}_n$ in each case by an amount x corresponding to an assumed initial maximum misalignment of the product starts 36 relative to one another against the product supply direction Z further than the respective preceding product.

In particular when, differing from this embodiment, no common supply unit for the product conveyors is provided, it is in principle, but generally, not compulsory to set the further products further back in each case by such an amount x than the respective preceding product that corresponds to an assumed initial maximum misalignment of the product starts 36 relative to one another.

As can likewise again in particular be recognized with reference to FIGS. 2 and 3, a respective light barrier 38, 40 which is arranged at a defined spacing from the cutting plane 16 and which comprises a lateral sensor 38 is associated with each product track along which a respective product 12 is conducted, the monitored zone 42 of said light barrier extending, starting from the side of the product support 14 adjacent to the product $\mathbf{12}_n$ set back the furthest, transversely to the product supply direction Z up to the rear end of the respective product track.

The control device 34 is further configured to travel the products 12 offset in a stepped manner with respect to one another via the common supply unit 24 toward the light barriers 38, 40 at a defined speed, to detect the positions of the product starts 36 with respect to the cutting plane 16 via the light barriers 38, 40, to determine the differences in the detected positions of the product starts 36 relative to one another and to travel the product conveyors 22 relative to one another for aligning the product starts 36 with the cutting plane 16 such that the determined relative positional differences of the product starts 36 are cancelled.

As can be recognized with reference to FIGS. 2 and 3, the lateral sensor 38 of a respective light barrier 38, 40 can in particular comprise both a light transmitter and a light receiver and the light beam 44 produced by the light transmitter can, starting from the respective side of the product support 14, be directed generally transversely to the product supply direction Z to a reflector 40 arranged directly behind the respective product track. In this case, the light barriers 38, 40 are therefore each configured as reflection light barriers.

A lateral arrangement of the sensors 38 is made possible by the described step-like offset of the products 12 and the stated association of the light barriers 38, 40 with the respective product tracks 39 and it is ensured that the light beam 44 of a respective light barrier 38, 40 is the first to be interrupted by the product 12 of the associated product track 39 and an interfering covering by the other products is prevented.

FIG. 2 shows an exemplary variant, in particular a variant suitable for a relatively smaller number of products 12, of the apparatus 10 in accordance with the invention or of the method in accordance with the invention.

In this case, the control apparatus 34 is inter alia configured, starting from one $\mathbf{12}_1$ of the two outermost products, to set the further products $\mathbf{12}_2$ to $\mathbf{12}_n$ arranged next to them up to the oppositely disposed outermost product $\mathbf{12}_n$ by a respective amount x corresponding to the assumed initial maximum misalignment of the product starts 36 relative to one another against the product supply direction Z further than the respective preceding product, wherein the sensors 38 of the light barriers 38, 40 associated with the different product tracks 39 are arranged at the side of the product support 14 adjacent to the product $\mathbf{12}_n$ set back the furthest.

In the present case, for example, up to four products 12 can be arranged next to one another. The amount x corresponding to the assumed initial maximum misalignment of the product starts 36 relative to one another by which the products 12 are each set back further against the product supply direction Z than the respective preceding product can, for example, amount to 30 mm so that the maximum offset between the product conveyors 22 associated with the two outermost products amounts to 90 mm. The taking into account of an assumed initial maximum misalignment of the product starts 36 relative to one another can therefore in particular be advantageous when only a limited maximum offset of the two outermost product conveyors is possible, for example on a use of a common supply unit for the product conveyors.

FIG. 3 shows a further exemplary variant, in particular a variant suitable for a relatively larger number of products 12, of the apparatus 10 in accordance with the invention or of the method in accordance with the invention.

In this case, the control apparatus 34 is in particular configured to set the products back, starting from a middle regional view transversely to the product supply direction Z or from a product $\mathbf{12}_1$ or $\mathbf{12'}_1$ arranged there, toward both sides up to the respective oppositely disposed outermost product $\mathbf{12}_n$ or $\mathbf{12'}_n$ by a respective amount x corresponding to the assumed initial maximum misalignment of the product starts 36 relative to one another against the product supply direction Z, and indeed further than the respective preceding product, wherein the sensors 38 of the light barriers 38, 40 which are associated with the product tracks 39 of the products 12 set back in a stepped manner toward the one aide are arranged at this one side of the product support 14, whereas the sensors 38 of the light barriers 38, 40 which are associated with the product tracks 39 of the products 12 set back in a stepped manner toward the other side are arranged at this other side of the product support 14.

In this case, for example, a total of eight products 12 can be provided next to one another, with four products $\mathbf{12}_1$ to $\mathbf{12}_n$ being set back toward the one side up to the oppositely disposed outermost product $\mathbf{12}_n$ by the respective amount x against the product supply direction Z, and indeed further than the respective preceding product, whereas the other four products $\mathbf{12'}_1$ to $\mathbf{12'}_n$ are each set back toward the other side up to the oppositely disposed outermost product $\mathbf{12}_n$ by the respective amount x against the product supply direction Z, and indeed further than the respective preceding product. The amount x corresponding to the initial maximum misalignment of the product starts 36 relative to one another can again amount to 30 mm, for example. Although in the present case with eight products, twice as many products are provided as before, the maximum offset between the product conveyors 22 still amounts to only 90 mm so that only a limited travel path of the product conveyors 22 is also required in this case.

REFERENCE NUMERAL LIST

10 slicing apparatus
12 product
$\mathbf{12}_1$ first or non-set back product
$\mathbf{12'}_1$ first or non-set back product
$\mathbf{12}_n$ product set back furthest
$\mathbf{12'}_n$ product set back furthest
14 product support
16 cutting plane
18 blade edge
20 rear end
22 product conveyor
24 supply unit
26 carrier
28 guide
30 spindle drive
32 spindle nut
34 control apparatus
36 product start
38 sensor
40 reflector
42 transition region
44 light beam
x assumed initial maximum misalignment of the product starts relative to one another
Z product supply direction

The invention claimed is:

1. A method of slicing products, comprising steps of:

supplying a plurality of products next to one another along a product support in a respective product track to a cutting plane in which a cutting blade moves, wherein the products are brought into engagement with respective product conveyors which can be traveled independently of one another in and against the product supply direction relative to the supply unit;

offsetting the products in a stepped manner relative to one another via the product conveyors in the product supply direction in that, starting from a first product, the further products arranged next to the first product at at least one side are each set back up to the respective outermost product by a respective amount against the product supply direction, and further than the respective preceding product;

wherein a respective light barrier having a monitored zone and a lateral sensor is associated with each product track, said light barrier being arranged at a defined spacing from the cutting plane and the monitored zone extending transversely to the product supply direction;

travelling the products toward the light barriers at a defined speed;

detecting positions of the product starts with respect to the cutting plane via the light barriers;

determining the differences in the positions of the product starts relative to one another; and travelling the product conveyors relative to one another for aligning the product starts with the cutting plane such that the determined relative positional differences of the product starts are cancelled.

2. The method in accordance with claim 1, wherein the lateral sensor of a respective light barrier comprises a light transmitter and a light receiver and a light beam generated by the light transmitter is directed, starting from the respective side of the product support, generally transversely to the product supply direction onto a reflector.

3. The method in accordance with claim 1, wherein starting from one of the two outermost products, the further products are set back up to the oppositely disposed outermost product by a respective amount against the product supply direction, and indeed further than the respective preceding product; and wherein the sensors of the light barriers are arranged at the side of the product support adjacent to the product set back furthest.

4. The method in accordance with claim 1, wherein the products, starting from a middle region, viewed transversely to the product supply direction, of the product support are set back toward both sides up to the oppositely disposed outermost product by a respective amount against the product supply direction, and further than the respective preceding product.

5. The method in accordance with claim 4, wherein the sensors associated with the product tracks of the products set back in a stepped manner toward the one side are arranged at this one side of the product support, whereas the sensors associated with the product tracks of the products set back in a stepped manner toward the other side are arranged at this other side of the product support.

6. The method in accordance with claim 1, wherein the products offset in a stepped manner relative to one another are traveled toward the light barriers at a constant speed.

7. The method in accordance with claim 6, wherein the product conveyors brought into engagement with the products are traveled differently far in and/or against the product supply direction relative to the supply unit before the offset in the stepped manner of the products.

8. The method in accordance with claim 1, wherein the amount by which the further products are each set back corresponds to an assumed initial maximum misalignment of the product starts relative to one another.

9. The method in accordance with claim 1, wherein the monitored zones of the light barriers, respectively starting from the side of the product support adjacent to the product set back the furthest, extend up to the rear margin of the respective product track.

10. An apparatus for slicing products, comprising:

a product support along which a plurality of products can be supplied next to one another in a respective product track to a cutting plane in which a cutting blade moves, wherein the products can be brought into engagement with respective product conveyors which can be traveled independently of one another in and against the product supply direction relative to the supply unit;

a control apparatus which is configured to offset the products in a stepped manner relative to one another via the product conveyors in the product supply direction such that, starting from a first product, the further products arranged next to the first product at at least one side are each set back up to the respective outermost product by a respective amount against the product supply direction , and further than the respective preceding product;

a respective light barrier having a monitored zone and a lateral sensor is associated with each product track, said light barrier being arranged at a defined spacing from the cutting plane and the monitored zone extending transversely to the product supply direction; wherein the control device is further configured to travel the products via a common supply unit toward the light barriers at a defined speed to detect positions of the product starts with respect to the cutting plane via the light barriers, to determine the differences in the positions of the product starts relative to one another and to travel the product conveyors relative to one another for aligning the product starts with the cutting plane such that the determined relative positional differences of the product starts are cancelled.

11. The apparatus in accordance with claim 10, wherein the apparatus is configured to carry out a method of slicing products.

12. The apparatus in accordance with claim 10, wherein the lateral sensor of a respective light barrier comprises a light transmitter and a light receiver and a light beam generated by the light transmitter is directed, starting from the respective side of the product support, generally transversely to the product supply direction onto a reflector.

13. The apparatus in accordance with claim 10, wherein the control apparatus is configured, starting from one of the two outermost products, to set back the further products arranged next to the one of the two outermost products up to the oppositely disposed outermost product by an amount against the product supply direction, and further than the respective preceding product; and wherein the lateral sensors associated with the different product tracks are arranged at the side of the product support adjacent to the product set back the furthest.

14. The apparatus in accordance with claim 10, wherein the control apparatus is configured to set back the products, starting from a middle region, viewed transversely to the product supply device, of the product support toward both sides up to the respective oppositely disposed outermost product by a respective amount against the product supply direction, and further than the respective preceding product.

15. The apparatus in accordance with claim 14, wherein the sensors associated with the product tracks of the products set back in a stepped manner toward the one side are arranged at this one side of the product support, whereas the sensors associated with the product tracks of the products set back in a stepped manner toward the other side are arranged at this other side of the product support.

16. The apparatus in accordance with claim 10, wherein the supply unit comprises a carrier extending transversely to the product supply direction and travelable in and against the product supply direction, at which carrier the product conveyors are supported travelable independently of one another.

17. The apparatus in accordance with claim 16, wherein the carrier is guided by means of lateral guides respectively extending in the product supply direction.

18. The apparatus in accordance with claim 10, wherein the amount by which the further products are each set back corresponds to an assumed initial maximum misalignment of the product starts relative to one another.

19. The apparatus in accordance with claim 10, wherein the monitored zones, respectively starting from the side of the product support adjacent to the product set back the furthest, extend up to the rear margin of the respective product track.

20. An apparatus for slicing a plurality of products, comprising:

a product support, configured to receive the plurality of products supplied next to one another along a plurality of product tracks of the product support, further configured to supply the plurality of products to a cutting plane;

a cutting blade configured to move in the cutting plane;

a plurality of product conveyors, configured to move independently of one another along a product supply direction and transverse to the product supply direction;

a control apparatus, configured to offset the products in a stepped manner relative to one another via the product conveyors in the product supply direction such that each product is offset from a preceding one of the products in a direction transverse to the product supply direction; and;

a plurality of light barriers, each associated with a respective one of the product tracks, each at a spacing from the cutting plane, each light barrier comprising a monitored zone which extends transversely to the product supply direction;

wherein the control apparatus is further configured:

to travel the products toward the light barriers at a defined speed;

to detect positions of product starts with respect to the cutting plane via the light barriers;

to determine differences in the positions of the product starts relative to one another; and to travel the product conveyors relative to one another to thereby align the product starts with the cutting plane and remove the differences in the positions of the product starts.

* * * * *